US009511590B2

(12) United States Patent
Kuramata et al.

(10) Patent No.: US 9,511,590 B2
(45) Date of Patent: Dec. 6, 2016

(54) LIQUID SUPPLY APPARATUS, LIQUID EJECTING APPARATUS, AND LIQUID SUPPLY METHOD

(71) Applicant: SEIKO EPSON CORPORATION, Tokyo (JP)

(72) Inventors: Shunsuke Kuramata, Shiojiri (JP); Ryoji Fujimori, Suwa (JP); Satoru Kobayashi, Matsumoto (JP); Seiya Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/838,603

(22) Filed: Aug. 28, 2015

(65) Prior Publication Data

US 2016/0067975 A1 Mar. 10, 2016

(30) Foreign Application Priority Data

Sep. 4, 2014 (JP) ..... 2014-180224

(51) Int. Cl.
*B41J 2/175* (2006.01)
*B41J 29/38* (2006.01)

(52) U.S. Cl.
CPC ..... *B41J 2/175* (2013.01); *B41J 2/1752* (2013.01); *B41J 2/17513* (2013.01); *B41J 2/17523* (2013.01); *B41J 2/17546* (2013.01); *B41J 2/17566* (2013.01); *B41J 29/38* (2013.01)

(58) Field of Classification Search
CPC ..... B41J 2/17556
See application file for complete search history.

(56) References Cited

U.S. PATENT DOCUMENTS

2002/0051021 A1* 5/2002 Mochizuki ..... B41J 2/17546 347/7
2005/0035985 A1 2/2005 Taguchi et al.
2006/0164472 A1* 7/2006 Perez ..... B41J 2/175 347/85
2008/0239029 A1* 10/2008 Hayashi ..... B41J 2/145 347/85
2009/0179972 A1* 7/2009 Yamamoto ..... B41J 2/175 347/85
2009/0251506 A1 10/2009 Ohnishi et al.
2011/0063345 A1* 3/2011 Cerro ..... B41J 2/175 347/7
2014/0022318 A1* 1/2014 Cameno ..... B41J 2/17546 347/86

FOREIGN PATENT DOCUMENTS

JP 2000-015837 A 1/2000
JP 2002-052731 A 2/2002
JP 2004-230857 A 8/2004
JP 2005-88568 A 4/2005
JP 2008-265009 A 11/2008

* cited by examiner

*Primary Examiner* — Shelby Fidler
(74) *Attorney, Agent, or Firm* — Workman Nydegger

(57) ABSTRACT

A liquid supply apparatus includes plural outlet flow paths respectively connected to the plural mounting units in which plural liquid storing bodies are respectively mounted, a supply flow path to which the plural outlet flow paths are connected, a switching unit capable of switching a communication status of each outlet flow path with the supply flow path, and a pressurizing and supplying unit that pressurizes and supplies liquid in the liquid storing bodies to the supply flow path. If the amount of liquid remaining in the liquid storing body communicating with one of the outlet flow paths is less than or equal to a second threshold greater than a first threshold, liquid in the liquid storing body communicating with another outlet flow path different from the one outlet flow path is made ready to be pressurized and supplied.

9 Claims, 5 Drawing Sheets

LIQUID SUPPLY APPARATUS, LIQUID EJECTING APPARATUS, AND LIQUID SUPPLY METHOD

BACKGROUND

1. Technical Field

The present invention relates to a liquid supply apparatus, a liquid ejecting apparatus, and a liquid supply method.

2. Related Art

As an example of a liquid ejecting apparatus, there is an ink jet printer that performs printing by ejecting ink from nozzles provided on a recording head. Among such printers, there is a printer in which two ink cartridges connected to each other are provided for each color. When ink in one of the ink cartridges is depleted, the ink cartridge is switched to the other ink cartridge, without suspending printing, so as to continue printing (for example, JP-A-2000-15837).

The printer described above includes an ink end detector that detects an ink end of each of the ink cartridges. Thus, when the ink end detector detects an ink end of one of the ink cartridges, the ink cartridge is switched to the other ink cartridge by opening and closing a valve. However, in the case of pressurizing ink stored in the ink cartridge and then supplying the ink to the recording head, ink is not sufficiently pressurized immediately after switching to the other ink cartridge. Thus, the supply pressure of ink might be reduced.

This problem is not limited to printers that perform printing by ejecting ink, but is generally common to those that pressurize and supply liquid while selectively switching between a plurality of liquid storing bodies.

SUMMARY

An advantage of some aspects of the invention is that there is provided a liquid supply apparatus, a liquid ejecting apparatus, and a liquid supply method capable of suppressing a reduction in liquid supply pressure upon switching between liquid storing bodies.

In the following, solutions for the above problem and advantageous effects thereof will be described below.

A liquid supply apparatus according to an aspect of the invention includes: a plurality of mounting units in which a plurality of liquid storing bodies that store liquid are removably mounted, respectively; a plurality of outlet flow paths having upstream ends connected to the plurality of mounting units, respectively; a supply flow path to which downstream ends of the plurality of outlet flow paths are connected; a switching unit capable of switching a communication status of each of the outlet flow paths with the supply flow path; a remaining amount detection unit capable of detecting an amount of liquid remaining in each of the liquid storing bodies; a pressurizing and supplying unit that pressurizes and supplies liquid in the liquid storing bodies to the supply flow path; and a control unit that controls the switching unit so as to place one of the plurality of outlet flow paths in a communicating state with the supply flow path and to place other outlet flow paths in a non-communicating state with the supply flow path, and drives the pressurizing and supplying unit upon supplying liquid in the liquid storing body communicating with the one outlet flow path; wherein when the remaining amount detection unit detects that the amount of liquid remaining in the liquid storing body communicating with the one outlet flow path is less than or equal to a second threshold greater than a first threshold, the control unit drives the pressurizing and supplying unit such that liquid in the liquid storing body communicating with another outlet flow path different from the one outlet flow path becomes ready to be pressurized and supplied, while maintaining the non-communicating state between the other outlet flow paths and the supply flow path.

According to this configuration, the liquid storing body in which the amount of the remaining liquid is less than or equal to the second threshold can supply liquid until at least the amount of the remaining liquid becomes less than or equal to the first threshold. That is, driving of the pressurizing and supplying unit may be started when the remaining amount detection unit detects that the amount of liquid remaining in the liquid storing body communicating with the one outlet flow path is less than or equal to the second threshold. Thus, while continuing to pressurize and supply liquid from the liquid storing body to the supply flow path, the liquid in the liquid storing body communicating with the other outlet flow path can be made ready to be pressurized and supplied. Accordingly, when the one outlet flow path communicating with the supply flow path is switched to the other outlet flow path, it is possible to promptly pressurize and supply the liquid in the liquid storing body communicating with the other outlet flow path to the supply flow path. Thus, it is possible to suppress a reduction in liquid supply pressure upon switching between the liquid storing bodies.

In the liquid supply apparatus described above, when the remaining amount detection unit detects that the amount of liquid remaining in the liquid storing body communicating with the one outlet flow path is less than or equal to the first threshold, the control unit controls the switching unit so as to place the one outlet flow path in a non-communicating state with the supply flow path.

According to this configuration, since the one outlet flow path is placed in a non-communicating state with the supply flow path after the amount of liquid remaining in the liquid storing body communicating with the one outlet flow path becomes less than or equal to the first threshold, it is possible to supply liquid in the liquid storing body communicating with the one outlet flow path to the supply flow path until the amount of liquid remaining in the liquid storing body becomes less than or equal to the first threshold.

In the liquid supply apparatus described above, the supplying and pressurizing unit is provided in plurality so as to correspond to the plurality of outlet flow paths, and liquid in the liquid storing bodies is pressurized by pressurization operations of the respective supplying and pressurizing units. The control unit starts the pressurization operation of the pressurizing and supplying unit corresponding to the other outlet flow path different from the one outlet flow path when the remaining amount detection unit detects that the amount of liquid remaining in the liquid storing body communicating with the one outlet flow path is less than or equal to the second threshold, and stops the pressurization operation of the pressurizing and supplying unit corresponding to the one outlet flow path after controlling the switching unit so as to place the one outlet flow path in the non-communicating state with the supply flow path.

According to this configuration, the pressurizing and supplying units are provided to correspond to the plurality of outlet flow paths. Therefore, it is possible to preliminarily pressurize the liquid in the liquid storing body communicating with the other outlet flow path, while pressurizing and supplying the liquid in the liquid storing body communicating with the one outlet flow path. Then, the control unit controls the switching unit so as to place the one outlet flow path in the non-communicating state with the supply flow path, and then stops the pressurizing operation of the pressurizing and supplying unit corresponding to the one outlet flow path. Therefore, it is possible to suppress a reduction in liquid supply pressure upon switching between the liquid storing bodies.

The liquid supply apparatus described above further includes a notifying unit capable of notifying of a detection result of the remaining amount detection unit. When the one outlet flow path is placed in the non-communicating state with the supply flow path, the notifying unit notifies that the amount of liquid remaining in the liquid storing body communicating with the one outlet flow path is less than or equal to the first threshold.

According to this configuration, when the notifying unit notifies that the amount of liquid remaining in the liquid storing body communicating with the one outlet flow path is less than or equal to the first threshold, the one outlet flow path is placed in the non-communicating state with the supply flow path. Therefore, it is possible to replace the liquid storing body communicating with the one outlet flow path, without stopping the liquid supply through the supply flow path.

A liquid ejecting apparatus according to another aspect includes: the liquid supply apparatus described above; and a liquid ejecting unit that ejects liquid supplied from the liquid supply apparatus.

According to this configuration, it is possible to achieve the same advantageous effects as those achieved by the liquid supply apparatus described above.

A liquid supply method according to still another aspect is a liquid supply method for selectively pressurizing and supplying liquid in one of a plurality of liquid storing bodies through a supply flow path to which a plurality of outlet flow paths communicating with the different liquid storing bodies are connected. The method includes: placing one of the plurality of outlet flow paths in a communicating state with the supply flow path while placing other outlet flow paths in a non-communicating state with the supply flow path, and pressurizing and supplying liquid in the liquid storing body communicating with the one outlet flow path; and when an amount of liquid remaining in the liquid storing body communicating with the one outlet flow path becomes less than or equal to a second threshold greater than a first threshold, performing preliminary pressurization such that liquid in the liquid storing body communicating with another outlet flow path different from the one outlet flow path becomes ready to be pressurized and supplied, while maintaining the non-communicating state between the other outlet flow paths and the supply flow path.

According to this configuration, it is possible to achieve the same advantageous effects as those achieved by the liquid supply apparatus described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings. The liquid ejecting apparatus is, for example, an ink jet printer that performs recording (printing) by ejecting ink, which is an example of liquid, onto a medium such as paper.

Figure 1:
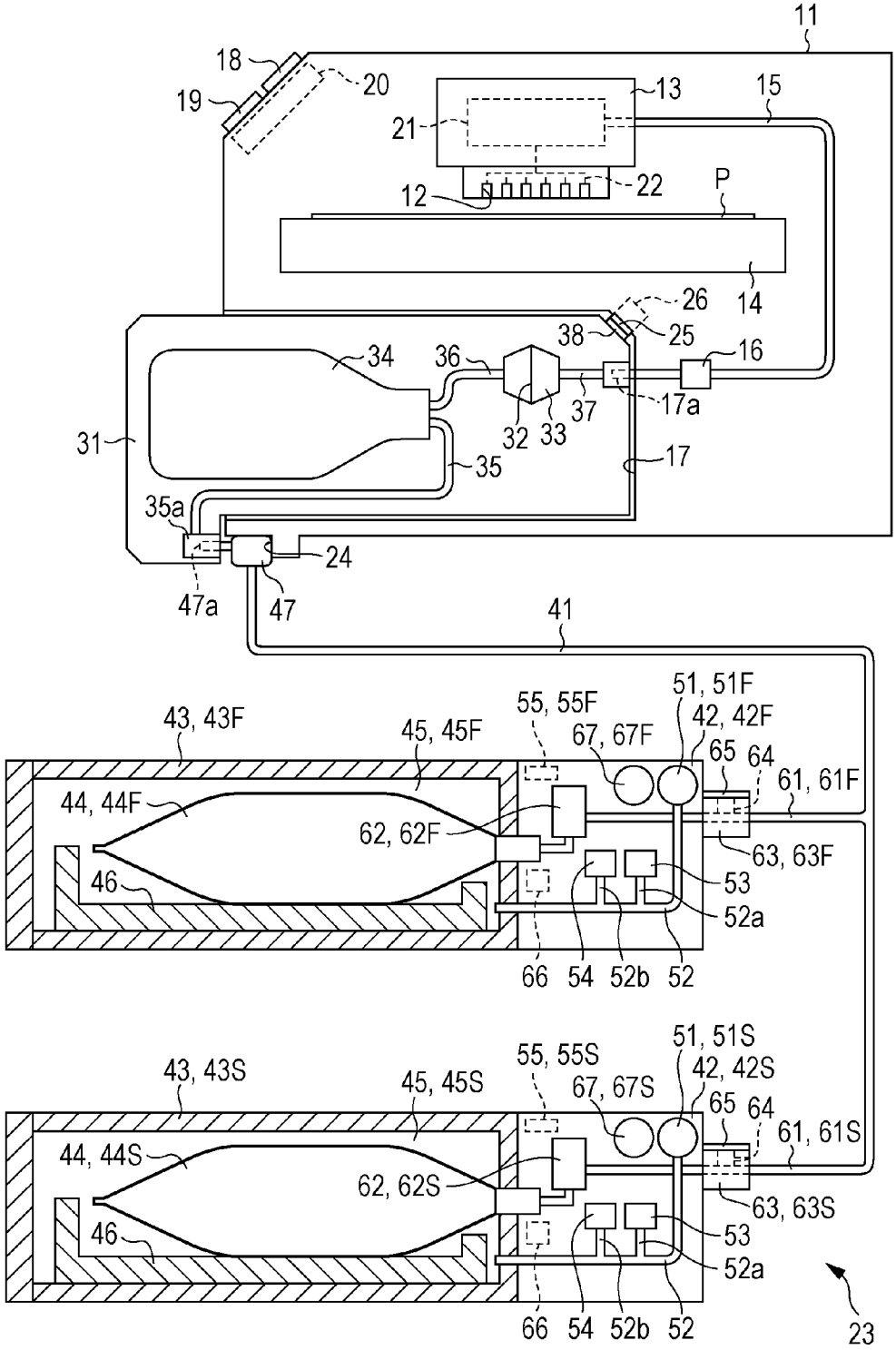
FIG. 1 is a schematic diagram illustrating a liquid ejecting apparatus and a liquid supply apparatus according to an embodiment.

As illustrated in FIG. 1, a liquid ejecting apparatus 11 of this embodiment includes a liquid ejecting unit 13 having a plurality of nozzles 12 that eject liquid onto a medium P, a medium support base 14 that supports the medium P, a liquid supply path 15 for supplying liquid to the liquid ejecting unit 13, a supply pump 16 provided in the middle of the liquid supply path 15, and a common mounting section 17. A supply needle 17*a* is provided at a downstream end of the liquid supply path 15. The liquid ejecting apparatus 11 further includes a main control unit 20 that controls the liquid ejecting unit 13 and so on, an operation unit 18 for inputting an instruction or the like to the main control unit 20, and a display unit 19 that displays control status or the like by the main control unit 20.

The liquid ejecting unit 13 includes a pressure adjusting mechanism 21 communicating with a downstream end of the liquid supply path 15, and a communication flow path 22 that allows communication between the pressure adjusting mechanism 21 and the nozzles 12. When the pressure of the communication flow path 22 becomes a negative pressure lower than a predetermined threshold Pm ($Pm<0$) due to ejection of liquid from the nozzles 12 or the like, the pressure adjusting mechanism 21 allows communication between the liquid supply path 15 and the communication flow path 22. On the other hand, when the pressure of the communication flow path 22 is greater than or equal to the threshold Pm, the pressure adjusting mechanism 21 regulates communication between the liquid supply path 15 and the communication flow path 22. Therefore, even if the inside of the liquid supply path 15 is put into a pressurized state by driving of the supply pump 16, since the pressure adjusting mechanism 21 regulates communication between the liquid supply path 15 and the communication flow path 22, no liquid is supplied to the nozzles 12.

A substitute mounting body 31 is removably mounted in the common mounting section 17. Note that in the case where the liquid ejecting unit 13 ejects a plurality of types of liquid (for example, a plurality of colors of ink, such as cyan, magenta, yellow, and black), the liquid ejecting apparatus 11 includes a plurality of common mounting sections 17.

A cartridge containing liquid (for example, ink cartridge containing ink (not illustrated)) is mounted in the common mounting section 17 so as to be replaceable with the substitute mounting body 31. The substitute mounting body 31 is provided with a circuit board 38. The common mounting section 17 is provided with a connection terminal 25 electrically connected to a terminal portion of the circuit board 38 and a connection detection unit 26. When the connection detection unit 26 detects information on the circuit board 38 connected to the connection terminal 25, the main control unit 20 determines which of the substitute mounting body 31 and the cartridge is mounted in the common mounting section 17.

The substitute mounting body 31 includes a filter chamber 33 that accommodates a filter 32, a storing container 34, a first supply path 35 having a downstream end inserted in the storing container 34, a second supply path 36 having an upstream end inserted in the storing container 34 and having a downstream end communicating with the filter chamber 33, and a third supply path 37 having an upstream end communicating with the filter chamber 33. The storing container 34 is a flexible tube container. For example, a blow molded resin bottle that is produced by blow molding is used as the storing container 34.

When the substitute mounting body 31 in which the storing container 34 that is filled with liquid in advance is mounted in the common mounting section 17, the liquid stored in the storing container 34 is driven by the supply pump 16 and supplied to the liquid ejecting unit 13. Thus, it is possible to perform printing on the medium P by ejecting liquid from the nozzles 12.

A plurality of (two in this embodiment) mounting units 43 are connected to the single substitute mounting body 31 via a supply flow path 41 and delivery mechanisms 42. The substitute mounting body 31, the supply flow path 41, the mounting units 43, and the delivery mechanisms 42 are included in a liquid supply apparatus 23 that supplies liquid to the liquid ejecting unit 13. Further, the liquid ejecting apparatus 11 and the liquid supply apparatus 23 are included in a liquid supply system.

Each mounting unit 43 includes an accommodating chamber 45 that accommodates a liquid storing body 44 storing liquid. Then, for example, by loading and unloading the liquid storing body 44 mounted on a tray 46 into and from the accommodating chamber 45, the liquid storing body 44 is mounted in and removed from the mounting unit 43.

A first connection portion 47 having a connection needle 47*a* is provided at a downstream end of the supply flow path 41. Further, a second connection portion 35*a* detachably connected to the connection needle 47*a* of the first connection portion 47 is provided at an upstream end of the first supply path 35 of the substitute mounting body 31.

The common mounting section 17 includes an attachment portion 24 to which the first connection portion 47 is removably attached. When the first connection portion 47 is properly attached to the attachment portion 24, the connection needle 47*a* protrudes from the common mounting section 17.

When the substitute mounting body 31 is mounted in the common mounting section 17 while the first connection portion 47 is attached to the attachment portion 24, the first connection portion 47 and the second connection portion 35*a* are connected to each other. Thus, the substitute mounting body 31 and the supply flow path 41 are connected to each other, and the supply needle 17*a* of the liquid supply path 15 and the third supply path 37 are connected to each other. In this way, by attaching the first connection portion 47 to the attachment portion 24 and by connecting the supply flow path 41 to the substitute mounting body 31, it is possible to deliver liquid from the liquid storing body 44 mounted in the mounting unit 43 to the substitute mounting body 31 through the supply flow path 41 and thus to continue printing for a longer period of time.

In this embodiment, the two mounting units 43 connected to the substitute mounting body 31 are a first mounting unit 43F and a second mounting unit 43S. The first mounting unit 43F and the second mounting unit 43S have the same configuration. Therefore, in the following description, the first mounting unit 43F and the second mounting unit 43S are referred to as "mounting units 43" when not referred to individually.

The accommodating chambers 45 corresponding to the first mounting unit 43F and the second mounting unit 43S are a first accommodating chamber 45F and a second accommodating chamber 45S. The delivery mechanisms 42 corresponding to the first mounting unit 43F and the second mounting unit 43S are a first delivery mechanism 42F and a second delivery mechanism 42S.

Each delivery mechanism 42 (42F, 42S) includes a pressurizing and supplying unit 51 (51F, 51S) that delivers pressurized gas, and a pressurized gas supply path 52 that introduces the pressurized gas delivered from the pressurizing and supplying unit 51 into the accommodating chamber 45. The pressurizing and supplying unit 51 delivers pressurized gas into the accommodating chamber 45 through the pressurized gas supply path 52, and thereby pressurizes and supplies the liquid stored in the liquid storing body 44 to the substitute mounting body 31.

The delivery mechanism 42 includes a pressure detection unit 53 connected to the pressurized gas supply path 52 via a first branch flow path 52*a*, and a valve element 54 capable of coming into and out of contact with an opening of a second branch flow path 52*b* connected to the pressurized gas supply path 52. The pressure detection unit 53 detects a pressure in the pressurized gas supply path 52.

The delivery mechanism 42 (42F, 42S) includes an outlet flow path 61 (a first outlet flow path 61F, a second outlet flow path 61S) having a downstream end connected to the supply flow path 41, a switching unit 62 (62F, 62S) that switches the communication status of the outlet flow path 61 with the supply flow path 41, a control unit 55 (55F, 55S), a remaining amount detection unit 63 (63F, 63S), and a drive source 67 (67F, 67S).

The drive source 67 is a motor rotatable in a first direction and a second direction opposite to the first direction, for example. The control unit 55 (55F, 55S) controls the pressurizing and supplying unit 51 (51F, 51S) and the switching unit 62 (62F, 62S) by controlling the drive source 67 (67F, 67S).

Further, the delivery mechanism 42 includes a mounting detection unit 66 capable of detecting whether the liquid storing body 44 is mounted in the accommodating chamber 45. For example, the mounting detection unit 66 detects that the liquid storing body 44 is mounted in the accommodating chamber 45 when a connection terminal (not illustrated) provided in the accommodating chamber 45 and a circuit board (not illustrated) provided in the liquid storing body 44 are electrically connected to each other. Note that the circuit board of the liquid storing body 44 is provided with a memory element that stores information such as the type and amount of liquid in the liquid storing body 44.

The remaining amount detection unit 63 is a sensor that detects that the amount of ink remaining in the liquid storing body 44 is less than or equal to a predetermined value. For example, the remaining amount detection unit 63 includes an elastically deformable elastic body 64 disposed in the outlet flow path 61, and a lever 65 whose position changes as the elastic body 64 deforms. The elastic body 64 compressed and deformed by the pressure of the liquid in the outlet flow path 61 is restored as the pressure of the liquid decreases. Thus, the remaining amount detection unit 63 detects a displacement of the lever 65 due to restoration of the elastic body 64.

For example, when the liquid stored in the liquid storing body 44 is depleted and no liquid flows out to the outlet flow path 61 even by pressurization, the pressure in the outlet flow path 61 decreases, so that the position of the lever 65 changes. Thus, it is possible to detect that the amount of the remaining liquid is less than or equal to a predetermined first threshold. If the amount of liquid stored in the liquid storing body 44 is greater than the first threshold, the remaining amount detection unit 63 detects a displacement of the lever 65 due to pressurization, thereby determines that the liquid in the liquid storing body 44 is sufficiently pressurized. Note that the first threshold has a value corresponding to an ink end state which requires the liquid storing body 44 to be replaced, for example.

The pressurizing and supplying unit 51 is, for example, a diaphragm pump, and delivers pressurized air into the accommodating chamber 45 through the pressurized gas supply path 52 when the drive source 67 is driven. Upon supplying liquid, the drive source 67 is driven such that the value of the pressure in the pressurized gas supply path 52 is equal to a predetermined pressure value Pn ($Ps \leq Pn < Pg$), under the control of the control unit 55. Further, if a detection value of the pressure detection unit 53 is greater than or equal to a maximum value Pg that is allowable as the pressure value Pn, the control unit 55 moves the valve element 54 to a position away from the opening of the second branch flow path 52*b* so as to reduce the pressure in the pressurized gas supply path 52 to an atmospheric pressure.

Figure 2:
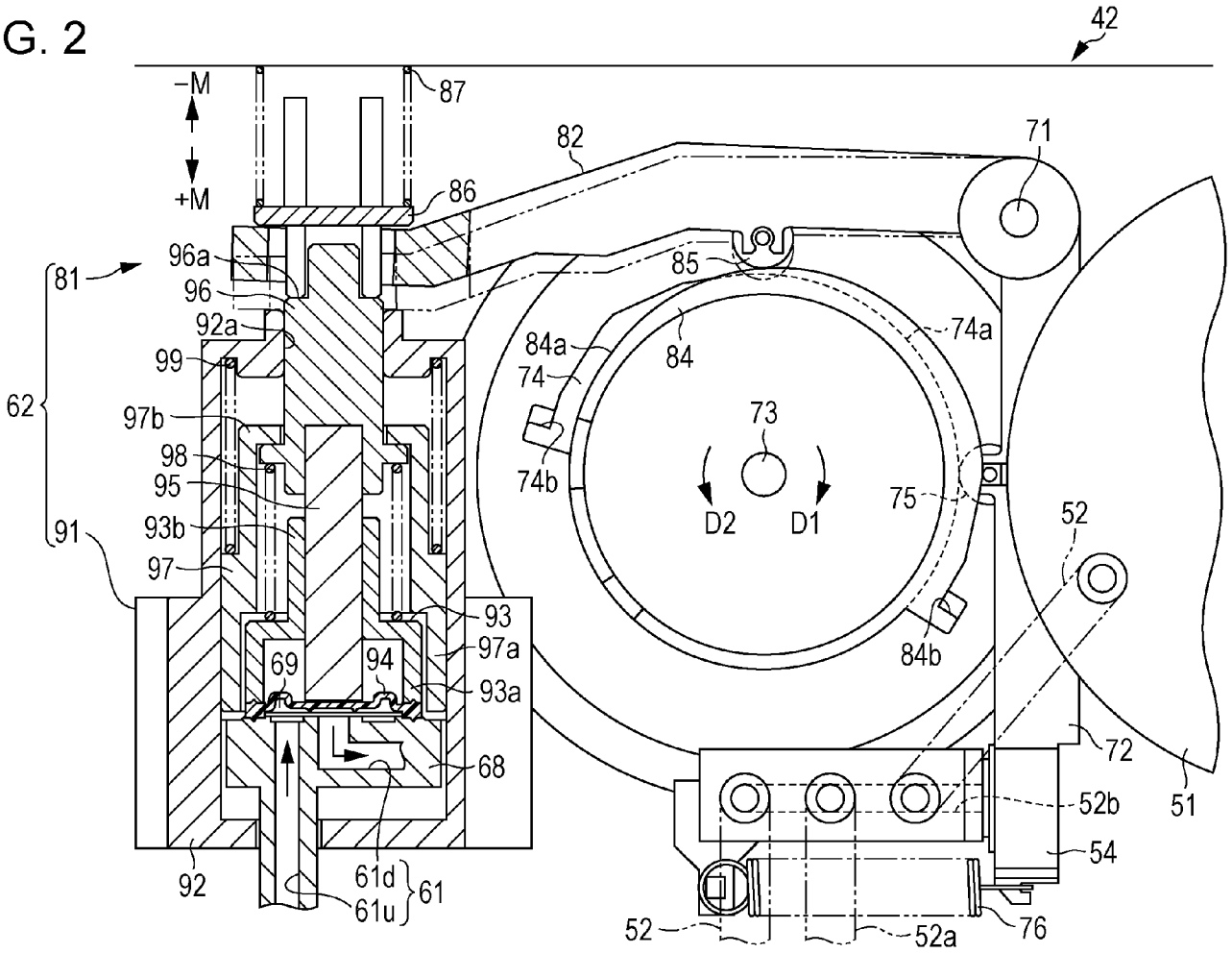
FIG. 2 is a cross-sectional view illustrating the configuration of a delivery mechanism.

As illustrated in FIG. 2, the valve element 54 is attached to a distal end of a first rotary lever 72 that is rotatable about a rotary shaft 71. A roller 75 engaging a first cam member 74 that is rotatable integrally with a drive shaft 73 rotated by the driving force of the drive source 67 (see FIG. 1) is rotatably attached between the rotary shaft 71 and the distal end on the first rotary lever 72. Note that the drive shaft 73 rotates in a first rotational direction D1 corresponding to a clockwise direction in FIG. 2 when the drive source 67 rotates in the first direction, and rotates in a second rotational direction D2 corresponding to a counterclockwise direction in FIG. 2 when the drive source 67 rotates in the second direction.

The first cam member 74 includes an inclined surface 74*a* inclined such that the distance from the drive shaft 73 gradually increases in the second rotational direction D2, and a locking projection 74*b* formed at a terminal end of the inclined surface 74*a* in the second rotational direction D2. The roller 75 engages the inclined surface 74*a*. Further, a valve element biasing member 76 (for example, a coil spring) that presses the valve element 54 toward the opening of the second branch flow path 52*b* is attached to the distal end of the first rotary lever 72.

When the first cam member 74 rotates in the first rotational direction D1, the distance of the roller 75 engaging the inclined surface 74*a* from the drive shaft 73 increases. Thus, the first rotary lever 72 rotates in the counterclockwise direction in FIG. 2 against the biasing force of the valve element biasing member 76. Then, when the valve element 54 moves in a direction away from the opening of the second branch flow path 52*b* in accordance with the rotation of the first rotary lever 72, the opening of the second branch flow path 52*b* is opened. Thus, the pressurized gas supply path 52 communicates with the atmosphere.

Next, the configuration of the switching unit 62 will be described in detail.

The switching unit 62 includes an opening/closing mechanism 91 capable of closing the outlet flow path 61, and a regulating unit 81 capable of regulating the operation of the opening/closing mechanism 91. The regulating unit 81 includes a second rotary lever 82 rotatable about the rotary shaft 71, a regulating member 86 capable of engaging a distal end of the second rotary lever 82, and a regulating biasing member 87 that biases the regulating member 86 toward the opening/closing mechanism 91.

A roller 85 engaging a second cam member 84 that is rotatable integrally with the drive shaft 73 is rotatably attached between the rotary shaft 71 and the distal end on the second rotary lever 82. The second cam member 84 includes an inclined surface 84*a* inclined such that the distance from the drive shaft 73 gradually increases in the first rotational direction D1, and a locking projection 84*b* formed at a terminal end of the inclined surface 84*a* in the first rotational direction D1. The roller 85 engages the inclined surface 84*a*.

The inclined surface 74*a* of the first cam member 74 and the inclined surface 84*a* of the second cam member 84 are inclined in opposite directions. That is, when the drive shaft 73 rotates in the first rotational direction D1, the roller 75 moves away from the drive shaft 73, whereas the roller 85 moves toward the drive shaft 73. Conversely, when the drive shaft 73 rotates in the second rotational direction D2, the roller 75 moves toward the drive shaft 73, whereas the roller 85 moves toward the drive shaft 73.

Figure 3:
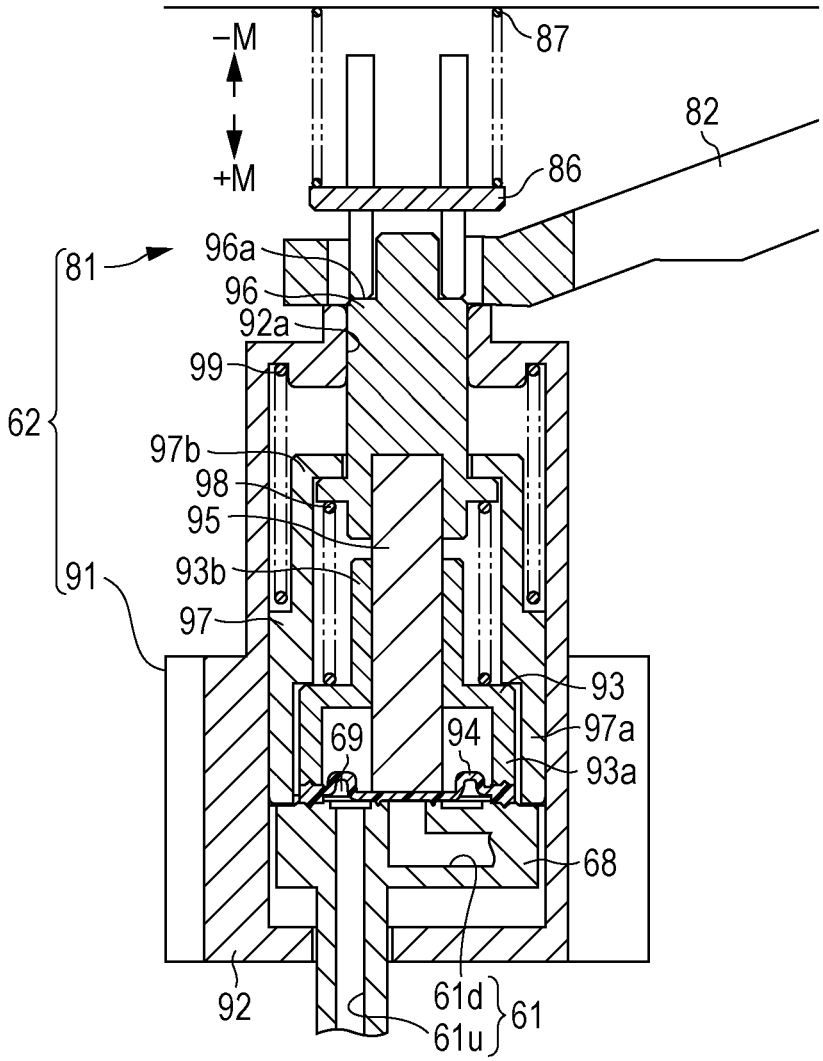
FIG. 3 is a cross-sectional view illustrating a switching unit at the time when a regulating member located in a regulating position.

When the second rotary lever 82 is in a non-engaged position indicated by the two-dot chain line in FIG. 2, the second rotary lever 82 does not engage the regulating member 86, and regulating member 86 is located in a regulating position illustrated in FIG. 3 with the biasing force of the regulating biasing member 87. Then, when the second cam member 84 rotates in the second rotational direction D2, the distance of the roller 85 engaging the inclined surface 84*a* from the drive shaft 73 increases. Thus, the second rotary lever 82 rotates in the clockwise direction in FIG. 2.

Figure 4:
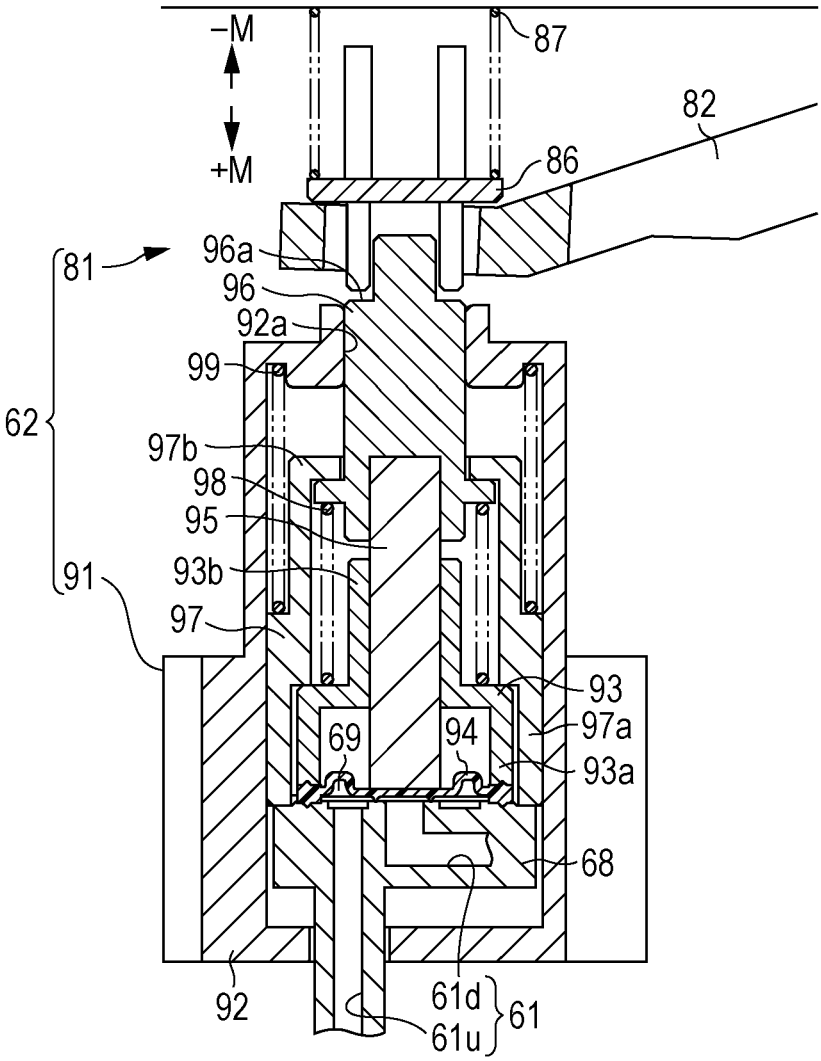
FIG. 4 is a cross-sectional view illustrating the switching unit at the time when the regulating member is located in a regulation releasing position.

Thus, the second rotary lever 82 rotates to a regulation releasing position indicated by the solid line in FIG. 2, and thereby moves the regulating member 86 from the regulating position illustrated in FIG. 3 to the regulation releasing position illustrated in FIGS. 2 and 4 against the biasing force of the regulating biasing member 87. Note that a direction from the regulation releasing position of the regulating member 86 toward the regulating position is a valve closing direction +M, and a direction from the regulating position toward the regulation releasing position is a valve closing direction −M.

Next, the configuration of the opening/closing mechanism 91 will be described in detail.

As illustrated in FIG. 2, the opening/closing mechanism 91 includes a substantially cylindrical case section 92 extending in the valve opening direction −M, and a fixing member 93 disposed in the case section 92. A flow path forming member 68 that forms the outlet flow path 61 is accommodated in the space of the case section 92 at the base end side in the valve opening direction −M. An insertion hole 92*a* is formed at the distal end of the case section 92 in the valve opening direction −M. Further, the regulating member 86 is disposed at the distal end side of the case section 92 in the valve opening direction −M.

The fixing member 93 includes a fixing cylindrical section 93*a* located at the base end side in the valve opening direction −M, and a guiding cylindrical section 93*b* located in a position closer to the insertion hole 92*a* than the fixing cylindrical section 93*a*. The guiding cylindrical portion 93*b* has an inner diameter and an outer diameter that are smaller than an inner diameter and an outer diameter, respectively, of the fixing cylindrical portion 93*a*. The fixing cylindrical section 93*a* fixes an outer edge portion of a substantially disk-shaped flexible member 94, which surrounds and defines a valve chamber 69 in the middle of the outlet flow path 61, with respect to the flow path forming member 68. The flexible member 94 functions as a valve element for closing the outlet flow path 61.

The outlet flow path 61 at the upstream side of the valve chamber 69 is an upstream flow path 61*u*, and the outlet flow path 61 at the downstream side of the valve chamber 69 is a downstream flow path 61*d*. The upstream flow path 61*u* and the downstream flow path 61*d* are formed in the flow path forming member 68, and open toward the flexible member 94. Then, the downstream flow path 61*d* is open near the center of the valve chamber 69 such that the center thereof is aligned with the central axis (indicated by the one-dot chain line illustrated in FIG. 2) of the case section 92. On the other hand, an opening of the upstream flow path 61*u* is disposed in a position displaced from the central axis of the case section 92 such that the opening faces a portion at the outer edge side of the flexible member 94 compared to the opening of the downstream flow path 61*d*.

A substantially column-shaped pressing member 95 is inserted in the guiding cylindrical portion 93*b* of the fixing member 93 so as to be slidable in the valve closing direction +M and the valve opening direction −M. A base end of the pressing member 95 in the valve opening direction −M is connected to the center portion of the flexible member 94.

When the pressing member 95 moves in the valve closing direction +M, as illustrated in FIGS. 3 and 4, the center portion of the flexible member 94 is pressed against the flow path forming member 68. Thus, the opening of the downstream flow path 61*d* is closed. On the other hand, when the pressing member 95 moves in the valve opening direction −M, as illustrated in FIG. 2, the center portion of the flexible member 94 moves away from the flow path forming member 68. Thus, the opening of the downstream flow path 61*d* is opened, so that the upstream flow path 61*u* and the downstream flow path 61*d* communicate with each other via the valve chamber 69.

A substantially column-shaped first moving body 96 is coupled to a distal end of the pressing member 95 in the valve opening direction −M. The first moving body 96 is inserted through the insertion hole 92*a* of the case section 92, and an engagement portion 96*a* capable of engaging the regulating member 86 is formed at distal end thereof in the valve opening direction −M.

A second moving body 97 is accommodated in the case section 92 so as to be movable in the valve closing direction +M and the valve opening direction −M. The second moving body 97 includes a cylindrical large diameter portion 97*a* that accommodates therein the fixing member 93 and the pressing member 95, and a small diameter portion 97*b* disposed in a position closer to the insertion hole 92*a* than the large diameter portion 97*a*. The small diameter portion 97*b* of the second moving body 97 has an opening portion at a distal end thereof in the valve opening direction −M. A base end of the first moving body 96 in the valve opening direction −M fits in the opening portion, so that the first moving body 96 and the second moving body 97 are combined as an integral unit. Accordingly, in the case where an external force is applied to either one of the pressing member 95, the first moving body 96, and the second moving body 97, the pressing member 95, the first moving body 96, and the second moving body 97 move as an integral unit in the case section 92 in the valve opening direction −M while being guided by the insertion hole 92*a* of the case section 92 and the guiding cylindrical section 93*b* of the fixing member 93.

Further, a valve opening biasing member 98 that biases the first moving body 96 in the valve opening direction −M and a valve closing biasing member 99 that biases the second moving body 97 in the valve closing direction +M are accommodated in the case section 92. Here, Fc1>Fc2>Fo, in which Fc1 is a biasing force of the valve closing biasing member 99; Fo is a biasing force of the valve opening biasing member 98; and Fc2 is a biasing force of the regulating biasing member 87.

When the regulating member 86 is in a regulating position as illustrated in FIG. 3, the regulating member 86 engages the engagement portion 96*a* of the first moving body 96. Accordingly, the biasing force of the regulating biasing member 87 is applied to the flexible member 94 via the first moving body 96 and the pressing member 95. Thus, the biasing force applied to the pressing member 95 in the valve closing direction +M via the first moving body 96 and the second moving body 97 is Fc1+Fc2, while the biasing force applied to the pressing member 95 in the valve opening direction −M is Fo. Since Fo<(Fc1+Fc2), the pressing member 95 moves in the valve closing direction +M and presses the flexible member 94 against the flow path forming member 68, thereby closing the opening of the downstream flow path 61*d*. Accordingly, the upstream flow path 61*u* and the downstream flow path 61*d* are placed in a non-communicating state.

On the other hand, when the regulating member 86 is in a regulation releasing position as illustrated in FIG. 4, the regulating member 86 is away from the first moving body 96. Accordingly, the biasing force of the regulating biasing member 87 is not applied to the first moving body 96. Thus, the biasing force applied to the pressing member 95 in the valve closing direction +M is Fc1, while the biasing force applied to the pressing member 95 in the valve opening direction −M is Fo. Since Fo<Fc1, the upstream flow path 61*u* and the downstream flow path 61*d* remain in the non-communicating state.

In this embodiment, a pressure Pf of pressurized liquid supplied through the outlet flow path 61 is set such that (Fo+Pf)>Fc1. That is, when a pressure of pressurized liquid supplied through the upstream flow path 61*u* is less than (Fc1−Fo), the upstream flow path 61*u* and the downstream flow path 61*d* are placed in the non-communicating state as illustrated in FIG. 4.

On the other hand, when the pressure of the pressurized liquid supplied through the upstream flow path 61*u* is greater than or equal to (Fc1−Fo), the pressing member 95 moves in the valve opening direction −M against the biasing force of the valve closing biasing member 99, so that the flexible member 94 moves away from the opening of the downstream flow path 61*d*. Then, the upstream flow path 61*u* and the downstream flow path 61*d* are placed in a communicating state, so that the pressurized liquid is supplied to the supply flow path 41 through the outlet flow path 61.

However, (Fo+Pf)<(Fc1+Fc2) in this embodiment. Therefore, when the regulating member 86 is in the regulating position, even if the pressurized liquid is supplied to the upstream flow path 61*u*, the upstream flow path 61*u* and the downstream flow path 61*d* are in the non-communicating state.

Next, operations of the valve element 54 and the regulating member 86 in accordance with displacement of the first cam member 74 and the second cam member 84 will be described.

When supplying liquid from the liquid storing body 44 to the supply flow path 41 through the outlet flow path 61, the control unit 55 causes the drive source 67 to rotate in the second direction, and thereby causes the drive shaft 73 to rotate in the second rotational direction D2. Further, the shapes of the inclined surface 74*a* and the inclined surface 84*a* are so set that, when the drive shaft 73 rotates in the second rotational direction D2, the first cam member 74 and the second cam member 84 are located in a first position, a second position, or a third position, in accordance with the rotation amount.

The first position is set when not supplying liquid. Thus, the valve element 54 opens the opening of the second branch flow path 52*b*, and the regulating member 86 is located in the regulating position (see FIG. 3). The roller 75 of the first rotary lever 72 is located in the vicinity of the terminal end of the inclined surface 74*a* near the locking projection 74*b* of the first cam member 74, and the roller 85 of the second rotary lever 82 is located in the vicinity of the starting end of the inclined surface 84*a* away from the locking projection 84*b* of the second cam member 84.

In the second position, the valve element 54 closes the opening of the second branch flow path 52*b* due to rotation of the first rotary lever 72, while the regulating member 86 remains in the regulating position (see FIG. 3). Note that since the pressurizing and supplying unit 51 is also driven by the drive source 67 while the cam members 74 and 84 rotate from the first position to the second position, the valve element 54 closes the opening of the second branch flow path 52*b*, so that delivery of pressurized air through the pressurized gas supply path 52 starts.

However, at this point, since the regulating member 86 is located in the regulating position, liquid pressurized by the pressurized air and flowed out from the liquid storing body 44 remains in the valve chamber 69. That is, at this point, the liquid in the liquid storing body 44 is preliminary pressurized in a range of (Fo+Pf)<(Fc1+Fc2) so as to be ready to be supplied.

When the drive shaft 73 further rotates in the second rotational direction D2 and thus the cam members 74 and 84 reach the third position, the regulating member 86 is located in the regulation releasing position due to rotation of the second rotary lever 82 while the opening of the second branch flow path 52*b* remains closed by the valve element 54. Then, the biasing force Fc2 of the regulating biasing member 87 having been applied in the valve closing direction +M is no longer applied, the flexible member 94 having been closed due to (Fo+Pf)<(Fc1+Fc2) is opened due to (Fo+Pf)>Fc1. Thus, the upstream flow path 61*u* and the downstream flow path 61*d* communicate with each other, so that liquid in the liquid storing body 44 is pressurized and supplied to the supply flow path 41.

Note that when the roller 85 comes into contact with the locking projection 84*b* in accordance with rotation of the second cam member 84, the cam members 74 and 84 stops rotating even if the drive source 67 continues rotating. Accordingly, liquid is supplied through the outlet flow path 61 and the supply flow path 41 while the regulating member 86 is located in the regulation releasing position.

Further, when stopping supply of liquid, the drive source 67 rotates in the first direction so as to rotate the drive shaft 73 in the first rotational direction D1. Then, while the drive shaft 73 rotates in the second rotational direction D2, the cam members 74 and 84 are displaced from the third position to the first position in accordance with the rotation amount.

First, when the cam members 74 and 84 are displaced from the third position to the second position, the regulating member 86 moves from the regulation releasing position to the regulating position due to rotation of the second rotary lever 82. Thus, the upstream flow path 61*u* and the downstream flow path 61*d* are placed in the non-communicating state, so that liquid stops flowing out from the outlet flow path 61 to the supply flow path 41 even if the pressurizing and supplying unit 51 is driven.

Subsequently, when the cam members 74 and 84 are displaced from the second position to the first position, the valve element 54 opens the opening of the second branch flow path 52*b* due to rotation of the first rotary lever 72. Thus, the pressurized gas supply path 52 is opened to the atmosphere, so that pressurization of the liquid storing body 44 is stopped.

Thereafter, when the roller 75 comes into contact with the locking projection 74*b* in accordance with rotation of the first cam member 74, the cam members 74 and 84 stop rotating even if the drive source 67 continues rotating. At this point, since the pressurized gas supply path 52 is opened to the atmosphere, even if the diaphragm pump as the pressurizing and supplying unit 51 is driven by the drive source 67, pressurized air is not delivered. Further, when the cam members 74 and 84 are in the first position, the regulating member 86 is located in the regulating position. Therefore, the flow of liquid from the outlet flow path 61 to the supply flow path 41 is regulated. Accordingly, when not supplying liquid, it is preferable to stop the drive source 67 after locating the cam members 74 and 84 in the first position.

Next, the electrical configuration of the liquid ejecting apparatus 11 and the liquid supply apparatus 23 of the liquid supply system will be described.

Figure 5:
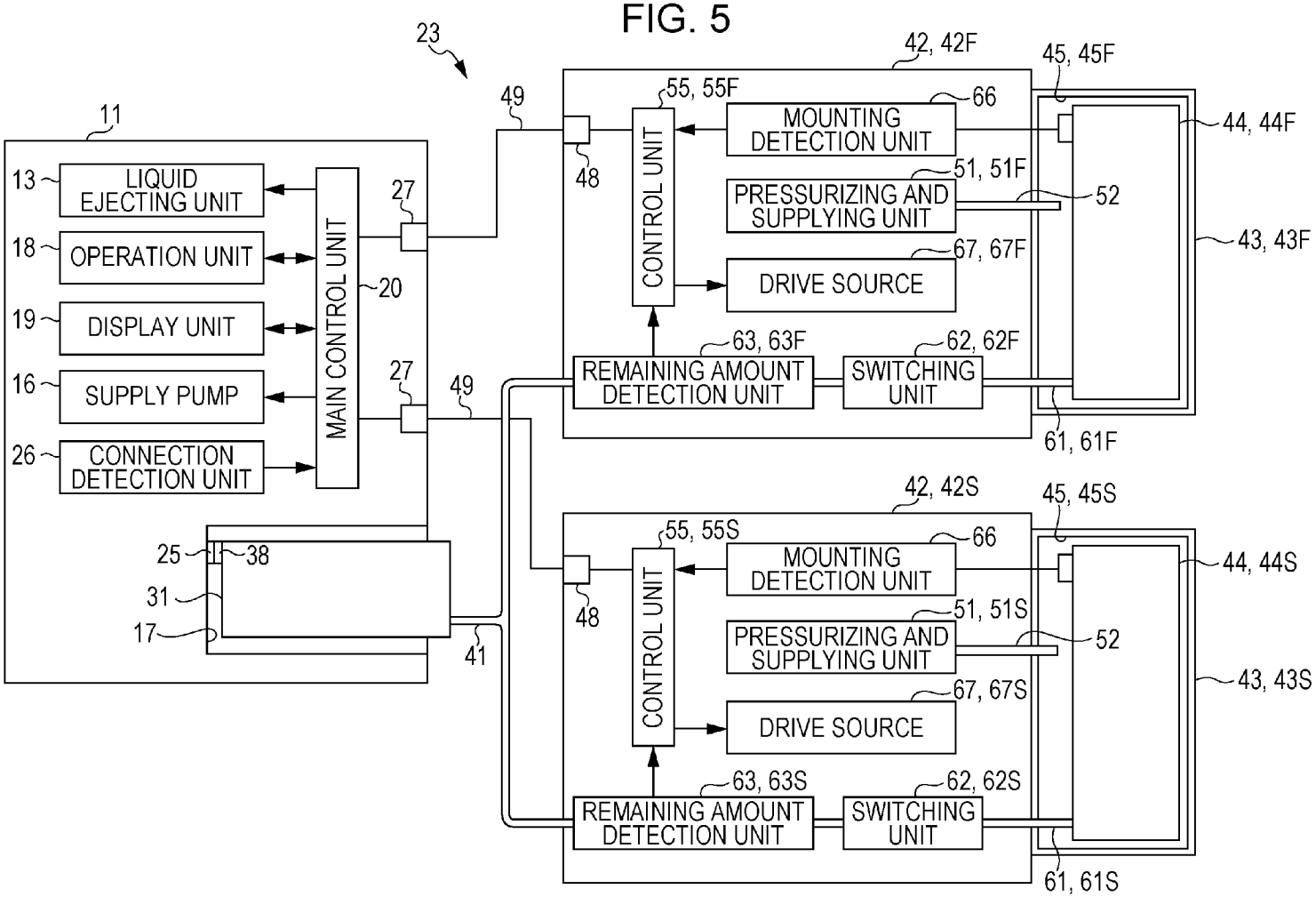
FIG. 5 is a block diagram illustrating the electric configuration of the liquid ejecting apparatus and a liquid supply apparatus.

As illustrated in FIG. 5, the liquid ejecting apparatus 11 includes a plurality of connectors 27, one for each of the delivery mechanisms 42. Each connector 27 is, for example, a USB connector, and electrically connects the delivery mechanism 42 to the liquid ejecting apparatus 11.

A cable 49 such as a USB cable connected to a connector 48 of the delivery mechanism 42 is connected to the connector 27. Thus, the main control unit 20 of the liquid ejecting apparatus 11 and the control unit 55 of the delivery mechanism 42 are communicably connected to each other via the connectors 27 and 48 and the cable 49.

Note that, although power may be supplied to the delivery mechanism 42 from the liquid ejecting apparatus 11 via the cable 49, it is preferable that the delivery mechanism 42 include a power plug and be driven with power supplied through the power plug.

The main control unit 20 of the liquid ejecting apparatus 11 is electrically connected to the liquid ejecting unit 13, the operation unit 18, the display unit 19, the supply pump 16, and the connection detection unit 26. The main control unit 20 transmits a detection result of the connection detection unit 26 to the control unit 55.

The control unit 55 of each delivery mechanism 42 is electrically connected to the mounting detection unit 66, the remaining amount detection unit 63, and the drive source 67. The control unit 55 transmits detection results of the mounting detection unit 66 and the remaining amount detection unit 63 to the main control unit 20. Further, the control units 55 (55F, 55S) control the respective drive sources 67 (67F, 67S) on the basis of detection results of the connection detection unit 26, the respective mounting detection units 66, and the respective remaining amount detection units 63 (63F, 63S), while exchanging information therebetween via the main control unit 20.

Next, a description will be given of control performed by the control units 55 such that the liquid storing body 44 to supply liquid to the substitute mounting body 31 is switched from a first liquid storing body 44F to a second liquid storing body 44S. Note that the following describes an example in which the liquid in the liquid storing body 44F is first supplied to the substitute mounting body 31 and, when the liquid in the liquid storing body 44F is depleted, switching of the outlet flow path 61 communicating the supply flow path 41 is performed so as to supply the liquid in the liquid storing body 44S to the substitute mounting body 31.

First, when the connection detection unit 26 detects the substitute mounting body 31 being mounted in the common mounting section 17, and the respective mounting detection units 66 detect that the liquid storing bodies 44 are mounted in all the mounting units 43, the main control unit 20 of the liquid ejecting apparatus 11 transmits information indicating this fact to the control units 55 (55F, 55S) of the delivery mechanisms 42 (42F, 42S).

The control unit 55F of the delivery mechanism 42F having received the information controls the drive source 67F so as to supply the liquid in the liquid storing body 44F to the substitute mounting body 31. More specifically, in one delivery mechanism 42F that supplies liquid, the control unit 55F drives the drive source 67F to rotate in the second direction.

Then, in the delivery mechanism 42F, the cam members 74 and 84 are displaced from the first position to the third position, so that the valve element 54 closes the opening of the second branch flow path 52*b*. As a result, pressurized air is delivered to the first accommodating chamber 45F through the pressurized gas supply path 52. Further, since the regulating member 86 is moved to the regulation releasing position, the liquid in the liquid storing body 44F pressurized in the first accommodating chamber 45F flows out to the downstream flow path 61*d* of the outlet flow path 61F in a pressurized state.

Then, when a pressure in the upstream flow path 61*u* exceeds Pf, the pressing member 95 of the opening/closing mechanism 91 moves in the valve opening direction −M, so that the upstream flow path 61*u* and the downstream flow path 61*d* communicate with each other. Thus, pressurized liquid is supplied to the substitute mounting body 31 through the outlet flow path 61F and the supply flow path 41.

On the other hand, in the other delivery mechanism 42S that does not supply liquid, the control unit 55S drives the drive source 67S in the first direction. Then, the cam members 74 and 84 are located in the first position, so that the valve element 54 moves away from the opening of the second branch flow path 52*b*. Accordingly, even when the drive source 67S is driven, pressurized air is not sent to the second accommodating chamber 45S. Further, since the second rotary lever 82 moves the regulating member 86 to the regulating position, the upstream flow path 61*u* and the downstream flow path 61*d* are forcibly placed in the non-communicating state. That is, while the liquid in the liquid storing body 44F is supplied to the substitute mounting body 31 via the delivery mechanism 42F, the liquid storing body 44S is placed in a non-communicating state with the supply flow path 41.

In this way, the control units 55 control the switching units 62 (62F, 62S) so as to place one outlet flow path 61F of the plurality of outlet flow paths 61 in a communicating state with the supply flow path 41 and to place the other outlet flow path 61S in a non-communicating state with the supply flow path 41, and drive the pressurizing and supplying unit 51F upon pressurizing and supplying liquid in the liquid storing body 44F communicating with the one outlet flow path 61F.

Note that, in the delivery mechanism 42S, the drive source 67S may be stopped after the regulating member 86 is moved to the regulating position by the second rotary lever 82. In the case where the cam members 74 and 84 are stopped in the first position, the drive source 67S of the delivery mechanism 42S does not need to be driven when delivering liquid via the delivery mechanism 42F.

Further, as a result of supplying liquid, when the remaining amount detection unit 63F detects that the amount of liquid remaining in the liquid storing body 44F communicating with the outlet flow path 61F is less than or equal to the second threshold greater than the first threshold, the control unit 55S drives the pressurizing and supplying unit 51S of the delivery mechanism 42S so as to start a pressurizing operation while maintaining the non-communicating state between the outlet flow path 61S and the supply flow path 41. That is, in order to prepare the liquid in the liquid storing body 44S communicating with the outlet flow path 61S different from the outlet flow path 61F ready to be pressurized and supplied, the control unit 55S performs preliminary pressurization of the liquid storing body 44S.

More specifically, the control unit 55S drives the drive source 67S in the second direction until the cam members 74 and 84 are displaced from the first position to the second position in the delivery mechanism 42S. Then, the valve element 54 closes the opening of the second branch flow path 52*b*. Thus, pressurized air is delivered to the accommodating chamber 45 through the pressurized gas supply path 52, so that the liquid in the liquid storing body 44S is preliminarily pressurized.

The second threshold has a value corresponding to a near-end state in which the amount of liquid remaining in the liquid storing body 44 is small. Note that a determination as to whether the amount of liquid remaining in the liquid storing body 44 is less than or equal to the second threshold may be made on the basis of the amount of displacement of the lever 65. Further, for example, the amount of liquid ejected by the liquid ejecting unit 13 may be counted by soft counting, and the amount of the remaining liquid may be calculated on the basis of the count value.

Then, as the delivery mechanism 42F continues to drive the drive source 67F, the liquid in the liquid storing body 44F is supplied to the substitute mounting body 31. When the remaining amount detection unit 63F detects that the amount of liquid remaining in the liquid storing body 44F is less than or equal to the first threshold, the control unit 55S drives the drive source 67S so as to displace the cam members 74 and 84 from the second position to the third position.

Then, in the delivery mechanism 42S, the regulating member 86 moves to the regulation releasing position. Thus, the liquid in the liquid storing body 44F preliminarily pressurized in the accommodating chamber 45 promptly flows out to the outlet flow path 61F in a sufficiently pressurized state, and is supplied to the substitute mounting body 31 through the supply flow path 41. In this way, in the case where the liquid in the liquid storing body 44F mounted in the first mounting unit 43F is delivered to the substitute mounting body 31 and consequently the liquid in the liquid storing body 44F is depleted, the liquid in the liquid storing body 44S mounted in the second mounting unit 43S is supplied to the substitute mounting body 31.

On the other hand, when the remaining amount detection unit 63F detects that the amount of liquid remaining in the liquid storing body 44F communicating with the outlet flow path 61F is less than or equal to the first threshold, the control unit 55F controls the switching unit 62F so as to place the outlet flow path 61F in a non-communicating state with the supply flow path 41. More specifically, the control unit 55F drives the drive source 67F in the first direction so as to rotate the cam members 74 and 84 in the first rotational direction D1. As a result, the cam members 74 and 84 are first displaced from the third position to the second position. Thus, the regulating member 86 moves to the regulating position, so that the outlet flow path 61F is placed in a non-communicating state with the supply flow path 41.

Subsequently, the cam members 74 and 84 are displaced from the second position to the first position. Thus, the pressurized gas supply path 52 is opened to the atmosphere, so that pressurization of the liquid storing body 44F is stopped. Then, when the roller 75 comes into contact with the locking projection 74*b* in accordance with rotation of the first cam member 74, the control unit 55F stops driving the drive source 67F.

That is, the control unit 55F controls the switching unit 62F so as to place the outlet flow path 61F in the non-communicating state with the supply flow path 41 by displacing the cam members 74 and 84 from the third position to the second position, and then stops the pressurizing operation of the pressurizing and supplying unit 51F corresponding to the outlet flow path 61F by displacing the cam members 74 and 84 from the second position to the first position. Then, by placing the outlet flow path 61F of the delivery mechanism 42F and the supply flow path 41 in the non-communicating state in this way, it is possible to replace the used liquid storing body 44F mounted in the first mounting unit 43F with a new one while performing printing by ejecting liquid supplied from the liquid storing body 44S with the liquid ejecting unit 13.

Note that in the case where the one outlet flow path 61F is placed in the non-communicating state with the supply flow path 41, it is preferable to notify, by the display unit 19, that the amount of liquid remaining in the liquid storing body 44F communicating with the one outlet flow path 61F is less than or equal to the first threshold. That is, the display unit 19 functions as a notifying unit capable of notifying of the detection result of the remaining amount detection unit 63.

Next, operations of the liquid ejecting apparatus 11 having the configuration described above will be described.

The liquid supply apparatus 23 includes: the plurality of mounting units 43 in which the plurality of liquid storing bodies 44 that store liquid are removably mounted, respectively; the plurality of outlet flow paths 61 having upstream ends connected to the plurality of mounting units 43, respectively; the supply flow path 41 to which downstream ends of the plurality of outlet flow paths 61 are connected; the switching unit 62 capable of switching the communication status of each of the outlet flow paths 61 with the supply flow path 41; and the remaining amount detection unit 63 capable of detecting the amount of liquid remaining in each of the liquid storing bodies 44. The liquid supply apparatus 23 employs a liquid supply method for selectively pressurizing and supplying liquid in one liquid storing body 44 of the plurality of liquid storing bodies 44 through the supply flow path 41 to which the plurality of outlet flow paths 61 communicating with the different liquid storing bodies 44 are connected.

That is, the liquid supply apparatus 23 places one outlet flow path 61F of the plurality of outlet flow paths 61 in a communicating state with the supply flow path 41 while placing the other outlet flow path 61S in a non-communicating state with the supply flow path 41, and pressurizes and supplies liquid in the liquid storing body 44F communicating with the one outlet flow path 61F (first supply step).

Further, when the amount of liquid remaining in the liquid storing body 44F communicating with the one outlet flow path 61F becomes less than or equal to the second threshold greater than the first threshold, the liquid supply apparatus 23 places liquid in the liquid storing body 44S communicating with the other outlet flow path 61S different from the one outlet flow path 61F in a state ready to be pressurized and supplied, while maintaining the non-communicating state between the other outlet flow path 61S and the supply flow path 41 (preliminary pressurization step).

Thereafter, when the amount of liquid remaining in the liquid storing body 44F becomes less than or equal to the first threshold, the liquid supply apparatus 23 switches the flow path to communicate with the supply flow path 41 from the outlet flow path 61F to the outlet flow path 61S by placing the outlet flow path 61F and the supply flow path 41 in a non-communicating state and placing the outlet flow path 61S and the supply flow path 41 in a communicating state (switching step). Note that in the switching step, the outlet flow path 61F and the supply flow path 41 may be placed in the non-communicating state after making the outlet flow path 61S communicate with the supply flow path 41, or these operations may be performed at the same time.

Thus, the liquid supply apparatus 23 pressurizes and supplies the liquid in the liquid storing body 44S through the outlet flow path 61S communicating with the supply flow path 41 by driving the pressurizing and supplying unit 51S (second supply step). Further, in the first mounting unit 43F having finished supply of liquid, the pressurized gas supply path 52 and the first accommodating chamber 45F are opened to the atmosphere, and then the driving of the pressurizing and supplying unit 51F is stopped.

Then, when the amount of liquid remaining in the liquid storing body 44F becomes less than or equal to the first threshold, the display unit 19 notifies that the liquid in the liquid storing body 44F is depleted, so that the user replaces the liquid storing body 44F. Thus, in the case where the liquid in the liquid storing body 44S is depleted, the outlet flow path 61S communicating with the supply flow path 41 is switched to the other outlet flow path 61F in the similar manner such that liquid in a replaced liquid storing body 44F can be supplied.

In this way, in the liquid supply apparatus 23, when the amount of liquid remaining in the one liquid storing body 44F becomes small, preliminary pressurization of the other liquid storing body 44S is started. Thus, when the outlet flow path 61F through which liquid flows out to the supply flow path 41 is switched to the other outlet flow path 61S in response to depletion of liquid in the liquid storing body 44F, a reduction in liquid supply pressure is suppressed. Therefore, it is possible to avoid a situation in which, immediately after switching between the liquid storing bodies 44, the liquid supply pressure decreases so that the supply of liquid becomes insufficient. Accordingly, it is possible to switch between the liquid storing bodies 44 without reducing the print quality even during printing.

Further, in the next liquid storing body 44S that supplies liquid, pressurization is started when the amount of liquid remaining in the liquid storing body 44F that is supplying liquid becomes small. Therefore, compared to the case where the other liquid storing body 44S not supplying liquid is always waiting in a pressurized state, it is possible to reduce wasteful driving of the pressurizing and supplying unit 51S.

According to the embodiment described above, the following effects may be obtained.

(1) The liquid storing body 44 in which the amount of the remaining liquid is less than or equal to the second threshold can supply liquid until at least the amount of the remaining liquid becomes less than or equal to the first threshold. That is, driving of the pressurizing and supplying unit 51S may be started when the remaining amount detection unit 63F detects that the amount of liquid remaining in the liquid storing body 44F communicating with the one outlet flow path 61F is less than equal to the second threshold. Thus, the liquid in the liquid storing body 44S communicating with the other outlet flow path 61S can be made ready to be pressurized and supplied, while continuing to pressurize and supply liquid from the liquid storing body 44F to the supply flow path 41. Thus, when the one outlet flow path 61F communicating with the supply flow path 41 is switched to the other outlet flow path 61S, it is possible to promptly pressurize and supply the liquid in the liquid storing body 44S communicating with the other outlet flow path 61S to the supply flow path 41. Accordingly, it is possible to suppress a reduction in liquid supply pressure upon switching between the liquid storing bodies 44.

(2) Since the one outlet flow path 61F is placed in a non-communicating state with the supply flow path 41 after the amount of liquid remaining in the liquid storing body 44F communicating with the one outlet flow path 61F becomes less than or equal to the first threshold, it is possible to supply liquid in the liquid storing body 44F communicating with the one outlet flow path 61F to the supply flow path 41 until the amount of liquid remaining in the liquid storing body 44F becomes less than or equal to the first threshold.

(3) The pressurizing and supplying units 51 (51F and 51S) are provided to correspond to the plurality of outlet flow paths 61 (61F and 61S). Therefore, it is possible to preliminarily pressurize the liquid in the liquid storing body 44S communicating with the other outlet flow path 61S, while pressurizing and supplying the liquid in the liquid storing body 44F communicating with the one outlet flow path 61F. Then, the control unit 55F controls the switching unit 62F so as to place the one outlet flow path 61F in the non-communicating state with the supply flow path 41, and then stops the pressurizing operation of the pressurizing and supplying unit 51F corresponding to the one outlet flow path 61F. Therefore, it is possible to suppress a reduction in liquid supply pressure upon switching between the liquid storing bodies 44.

(4) When the display unit 19 notifies that the amount of liquid remaining in the liquid storing body 44F communicating with the one outlet flow path 61F is less than or equal to the first threshold, the one outlet flow path 61F is placed in the non-communicating state with the supply flow path 41. Therefore, it is possible to replace the liquid storing body 44F communicating with the one outlet flow path 61F, without stopping the liquid supply through the supply flow path 41.

(5) In the delivery mechanism 42, the pressurizing and supplying unit 51 and the switching unit 62 are driven by the driving force of the common drive source 67. Therefore, it is possible to simplify the configuration compared to the case in which separate drive sources are provided for the pressurizing and supplying units 51 and the switching unit 62.

(6) In the switching unit 62, the upstream flow path 61*u* and the downstream flow path 61*d* communicate with each other in response to the pressure of the liquid flowing through the upstream flow path 61*u* reaching a predetermined value in addition to movement of the regulating member 86 from the regulating position to the regulation releasing position. Therefore, it is possible to allow communication between the outlet flow path 61S and the supply flow path 41 after sufficiently increasing the liquid supply pressure of the outlet flow path 61S. Further, in the switching unit 62, the status of communication between the upstream flow path 61*u* and the downstream flow path 61*d* is switched on the basis of the difference in biasing force between the plurality of biasing members 87, 98, and 99. Therefore, it is possible to accurately control the pressure status while simplifying the configuration of the apparatus.

The embodiment described above may be modified as in the following modifications.

Three or more outlet flow paths 61 may be connected to the supply flow path 41. Thus, liquid may be supplied to the liquid ejecting unit 13 while selectively switching between liquid storing bodies 44 respectively connected to three or more mounting units 43.

A single pressurizing and supplying unit 51 may be provided for the plurality of mounting units 43. In this case, it is preferable to provide pressurized gas supply paths 52 that supply pressurized air from the single pressurizing and supplying unit 51 to the respective plurality of accommodating chambers 45, and to provide a switching unit that switches the flow of the pressurized air to the pressurized gas supply paths 52.

A single control unit 55 may be provided for the plurality of mounting units 43.

The supply pump 16 of the liquid ejecting apparatus 11 may be a pressurizing pump, and the liquid in the liquid storing body 44 mounted in the mounting unit 43 may be pressurized by the pressurizing force of the pressurizing pump.

The pressurizing and supplying unit 51 is not limited to a pump. For example, a pressurizing and supplying unit 51 that performs a pressurizing operation by pressing the liquid storing body 44. Further, the pressurizing and supplying unit 51 may be a lifting device that performs a pressurizing operation by moving the mounting unit 43 upward so as to pressurize and supply liquid using the head difference.

The liquid storing body 44 may be in the form of a bag formed of a flexible film member that is flexibly deformed by pressurization. In this case, when pressure is applied by delivering pressurized air into the space outside the bag-shaped liquid storing body 44, the film member is flexibly displaced such that the internal volume of the bag is reduced. Thus, with the film member that is flexibly displaced, it is possible to pressurize the liquid stored in the liquid storing body 44.

The liquid storing body 44 may be in the form of a box having an inlet port for pouring liquid therein and formed by resin molding or the like. In this case, when the liquid storing body 44 is mounted in the accommodating chamber 45 with the inlet port open, it is possible to pressurize the liquid in the liquid storing body 44 directly with the pressurized air. Further, in the case where the liquid storing body 44 has an inlet port, the liquid storing body 44 may not be removable from the accommodating chamber 45, and may not be removable from the mounting unit 43.

The switching unit 62 that switches the outlet flow path 61 communicating the supply flow path 41 is not limited to one including the opening/closing mechanism 91 and the regulating unit 81 and provided in the mounting unit 43. For example, a three-way switching valve may be provided as the switching unit 62 at the connection between the outlet flow paths 61F and 61S and the supply flow path 41. That is, the switching unit 62 does not need to be provided for each of the outlet flow paths 61.

The liquid supply apparatus 23 may not include the substitute mounting body 31, and the first connection portion 47 of the supply flow path 41 may be connected to the upstream end of the liquid supply path 15. In this case, a sub-tank for temporarily storing liquid may be provided in the middle of the liquid supply path 15, and pressurized liquid may be intermittently supplied from the mounting unit 43 in accordance with the amount of liquid stored in the sub-tank. Further, in the case of intermittently supplying liquid from the mounting unit 43, an on-off valve capable of closing the supply flow path 41 may be provided so as to control the timing of supplying liquid to the sub-tank by opening and closing the on-off valve. Further, the amount of liquid remaining in the liquid storing body 44 may be estimated on the basis of the amount of liquid supplied to the sub-tank per time.

The remaining amount detection unit 63 that detects whether the amount of liquid remaining in the liquid storing body 44 is less than or equal to the first threshold and the second threshold may not be a sensor that physically detects the pressure of liquid, but may count the amount of liquid ejected by the liquid ejecting unit 13 by soft counting and calculate the amount of the remaining liquid on the basis of the count value.

When the amount of liquid remaining in the liquid storing body 44 becomes less than or equal to the second threshold, a notifying unit (the display unit 19 in this embodiment) may inform of this fact.

The notifying unit is not limited to the display unit 19 that visually notifies of information. For example, the notifying unit may audibly notify of information, or notify of information by turning on or off an indicator light. Alternatively, information may be displayed on a screen of a host apparatus such as a computer connected to the liquid ejecting apparatus 11.

The notifying unit may be provided in the liquid supply apparatus 23.

A main body unit into which the plurality of mounting units 43 that are switched are integrated may be provided, and the main body unit and the liquid ejecting apparatus 11 may be connected to each other with the single cable 49.

The plurality of mounting units 43 may be integrated with the liquid ejecting apparatus 11. That is, the mounting units 43 may not be removable from the liquid ejecting apparatus 11, and the liquid ejecting apparatus 11 may include the liquid supply apparatus 23. In this case, the control units 55 may not be provided, and the main control unit 20 may control the delivery mechanisms 42.

Liquid ejected by the liquid ejecting unit 13 is not limited to ink, but may be, for example, a liquid body in which particles of a functional material are dispersed or mixed in liquid. For example, recording may be performed by ejecting a liquid body containing a material such as an electrode material and a color material (pixel material) used in production of liquid crystal displays, electroluminescent (EL) displays, and surface-emitting displays, in a dispersed or dissolved form.

The medium P is not limited to paper, but may be a plastic film or a thin plate material, or may be fabric used in a fabric printing apparatus or the like.

Further, a technical idea conceivable from the embodiment and modifications described above will be described below.

(a) A liquid supply apparatus wherein a first liquid storing body and a second liquid storing body are provided as liquid storing bodies that store liquid, the liquid supply apparatus including: a first mounting unit in which the first liquid storing body is removably mounted; a second mounting unit in which the second liquid storing body is removably mounted; a first outlet flow path having an upstream end connected to the first mounting unit; a second outlet flow path having an upstream end connected to the second mounting unit; a supply flow path to which a downstream end of the first outlet flow path and a downstream end of the second outlet flow path are connected; a switching unit capable of switching a communication status of each of the first outlet flow path and the second outlet flow path with the supply flow path; a remaining amount detection unit capable of detecting an amount of liquid remaining in each of the liquid storing bodies; a pressurizing and supplying unit that pressurizes and supplies liquid in the liquid storing bodies to the supply flow path; and a control unit that controls the switching unit so as to place one of the first outlet flow path and the second outlet flow path in a communicating state with the supply flow path and to place another of the first outlet flow path and the second outlet flow path in a non-communicating state with the supply flow path, and drives the pressurizing and supplying unit upon supplying liquid in the liquid storing bodies; wherein when the remaining amount detection unit detects that the amount of liquid remaining in the first liquid storing body is equal to a second threshold greater than a first threshold due to supply of liquid, the control unit drives the pressurizing and supplying unit such that liquid in the second liquid storing body becomes ready to be pressurized and supplied, while maintaining the non-communicating state between the second outlet flow path and the supply flow path.

According to this configuration, the first liquid storing body in which the amount of the remaining liquid is less than or equal to the second threshold can supply liquid until at least the amount of the remaining liquid becomes less than or equal to the first threshold. That is, driving of the pressurizing and supplying unit may be started when the remaining amount detection unit detects that the amount of liquid remaining in the first liquid storing body is less than or equal to the second threshold. Thus, the liquid in the second liquid storing body can be made ready to be pressurized and supplied, while continuing to pressurize and supply liquid from the first liquid storing body to the supply flow path. Accordingly, when the first outlet flow path communicating with the supply flow path is switched to the second outlet flow path, it is possible to promptly pressurize and supply the liquid in the second liquid storing body to the supply flow path. Thus, it is possible to suppress a reduction in liquid supply pressure upon switching between the liquid storing bodies.

The entire disclosure of Japanese Patent Application No. 2014-180224, filed Sep. 4, 2014 is expressly incorporated by reference herein.

What is claimed is:

1. A liquid supply apparatus comprising:

a plurality of mounting units in which a plurality of liquid storing bodies that store liquid are removably mounted, respectively;

a plurality of outlet flow paths having upstream ends connected to the plurality of mounting units, respectively;

a supply flow path to which downstream ends of the plurality of outlet flow paths are connected;

a switching unit capable of switching a communication status of each of the outlet flow paths with the supply flow path;

a remaining amount detection unit capable of detecting an amount of liquid remaining in each of the liquid storing bodies;

a pressurizing and supplying unit that pressurizes and supplies liquid in the liquid storing bodies to the supply flow path; and a control unit that controls the switching unit so as to place one of the plurality of outlet flow paths in a communicating state with the supply flow path and to place other outlet flow paths in a non-communicating state with the supply flow path, and drives the pressurizing and supplying unit upon supplying liquid in the liquid storing body communicating with the one outlet flow path;

wherein when the remaining amount detection unit detects that the amount of liquid remaining in the liquid storing body communicating with the one outlet flow path is less than or equal to a second threshold greater than a first threshold, the control unit drives the pressurizing and supplying unit such that liquid in the liquid storing body communicating with another outlet flow path different from the one outlet flow path becomes ready to be pressurized and supplied, while maintaining the non-communicating state between the other outlet flow paths and the supply flow path, and wherein the control unit starts the pressurization operation of the pressurizing and supplying unit corresponding to the other outlet flow path different from the one outlet flow path when the remaining amount detection unit detects that the amount of liquid remaining in the liquid storing body communicating with the one outlet flow path is less than or equal to the second threshold, and stops the pressurization operation of the pressurizing and supplying unit corresponding to the one outlet flow path after controlling the switching unit so as to place the one outlet flow path in the non-communicating state with the supply flow path.

2. The liquid supply apparatus according to claim 1, wherein when the remaining amount detection unit detects that the amount of liquid remaining in the liquid storing body communicating with the one outlet flow path is less than or equal to the first threshold, the control unit controls the switching unit so as to place the one outlet flow path in a non-communicating state with the supply flow path.

3. The liquid supply apparatus according to claim 2, wherein the supplying and pressurizing unit is provided in plurality so as to correspond to the plurality of outlet flow paths, and liquid in the liquid storing bodies is pressurized by pressurization operations of the respective supplying and pressurizing units.

4. The liquid supply apparatus according to claim 2, further comprising:

a notifying unit capable of notifying of a detection result of the remaining amount detection unit;

wherein when the one outlet flow path is placed in the non-communicating state with the supply flow path, the notifying unit notifies that the amount of liquid remaining in the liquid storing body communicating with the one outlet flow path is less than or equal to the first threshold.

5. A liquid ejecting apparatus comprising:

the liquid supply apparatus of claim 1; and a liquid ejecting unit that ejects liquid supplied from the liquid supply apparatus.

6. A liquid ejecting apparatus comprising:

the liquid supply apparatus of claim 2; and a liquid ejecting unit that ejects liquid supplied from the liquid supply apparatus.

7. A liquid ejecting apparatus comprising:

the liquid supply apparatus of claim 3; and a liquid ejecting unit that ejects liquid supplied from the liquid supply apparatus.

8. A liquid ejecting apparatus comprising:

the liquid supply apparatus of claim 4; and a liquid ejecting unit that ejects liquid supplied from the liquid supply apparatus.

9. A liquid supply method for selectively pressurizing and supplying liquid in one of a plurality of liquid storing bodies through a supply flow path to which a plurality of outlet flow paths communicating with the different liquid storing bodies are connected, the method comprising:

placing one of the plurality of outlet flow paths in a communicating state with the supply flow path while placing other outlet flow paths in a non-communicating state with the supply flow path, and pressurizing and supplying liquid in the liquid storing body communicating with the one outlet flow path; and when an amount of liquid remaining in the liquid storing body communicating with the one outlet flow path becomes less than or equal to a second threshold greater than a first threshold, performing pressurization such that liquid in the liquid storing body communicating with another outlet flow path different from the one outlet flow path becomes ready to be pressurized and supplied, while maintaining the non-communicating state between the other outlet flow paths and the supply flow path;

wherein the pressurization of the liquid storing body communicating with the another outlet flow path different from the one outlet flow path starts when the amount of liquid in the liquid storing body communicating with the one outlet flow path is less than or equal to the second threshold, and wherein the pressurization of the liquid storing body communicating with the one outlet flow path is stopped after the one outlet flow path is placed in the non-communicating state with the supply flow path.

* * * * *